US011519271B2

(12) United States Patent
Hartnagel et al.

(10) Patent No.: US 11,519,271 B2
(45) Date of Patent: Dec. 6, 2022

(54) TURBINE ENGINE ROTOR WITH FLEXIBLY COUPLED TIE BOLT

(71) Applicants: Rolls-Royce North American Technologies Inc., Indianapolis, IN (US); Rolls-Royce Corporation, Indianapolis, IN (US)

(72) Inventors: Brett Hartnagel, Brownsburg, IN (US); Brandon Snyder, Greenwood, IN (US); Michael Whitten, Zionsville, IN (US)

(73) Assignees: Rolls-Royce North American Technologies Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 253 days.

(21) Appl. No.: 16/893,796

(22) Filed: Jun. 5, 2020

(65) Prior Publication Data

US 2021/0381381 A1 Dec. 9, 2021

(51) Int. Cl.
*F01D 5/06* (2006.01)
*F01D 5/02* (2006.01)

(52) U.S. Cl.
CPC ..... *F01D 5/066* (2013.01); *F01D 5/026* (2013.01); *F05D 2240/61* (2013.01); *F05D 2260/38* (2013.01)

(58) Field of Classification Search
CPC ..... F01D 5/026; F01D 5/066; F05D 2240/61; F05D 2240/62; F05D 2260/38; F16D 3/72; F16D 3/725; F16D 3/74; F16B 35/041; F16B 31/04; F16B 5/0241
See application file for complete search history.

(56) References Cited

U.S. PATENT DOCUMENTS

| | | | | |
|---|---|---|---|---|
| 2,483,616 | A * | 10/1949 | Abdon Bergstedt | F01D 5/066 416/171 |
| 3,692,337 | A | 9/1972 | Mischel | |
| 4,802,882 | A | 2/1989 | Heidrich | |
| 5,000,722 | A | 3/1991 | Zilberman | |
| 5,697,848 | A * | 12/1997 | Bosley | H02K 7/16 464/182 |
| 7,824,305 | B2 | 11/2010 | Duong et al. | |
| 7,896,748 | B2 | 3/2011 | Muskus et al. | |
| 8,523,686 | B2 | 9/2013 | Goujet | |
| 9,279,327 | B2 * | 3/2016 | Shepherd | F01D 5/066 |
| 10,012,315 | B2 | 7/2018 | Barger et al. | |

FOREIGN PATENT DOCUMENTS

DE 102012207783 1/2017

* cited by examiner

*Primary Examiner* — Woody A Lee, Jr.
*Assistant Examiner* — Jesse M Prager
(74) *Attorney, Agent, or Firm* — Barnes & Thornburg LLP

(57) ABSTRACT

A rotor assembly includes a plurality of wheels and a tie bolt that extends through the plurality of wheels and applies a compressive force to the plurality of wheels. The tie bolt includes a first segment with a first stiffness and a second segment with a second stiffness to allow for thermal growth of the plurality of wheels.

20 Claims, 5 Drawing Sheets

TURBINE ENGINE ROTOR WITH FLEXIBLY COUPLED TIE BOLT

FIELD OF THE DISCLOSURE

The present disclosure relates generally to gas turbine engines, and more specifically to rotor assemblies for use in gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Compressors and turbines typically include alternating stages of static vane assemblies and rotating wheel assemblies. The rotating wheel assemblies include disks carrying blades around their outer edges. The rotating wheel assemblies for a compressor or a turbine are coupled together in series to transfer torque delivered or generated across the multiple rotating wheel assemblies. The multiple rotating wheel assemblies are clamped together by bolted joints, tie-bolt configurations, etc.

Due to the differing coefficients of thermal expansion in a tie-bolt configuration, the rotating wheel assemblies and the tie bolt may expand at different rates through different point of an engine cycle. This may cause the rotating wheel assemblies to shrink faster than the tie-bolt resulting in a loss of clamp load across the wheel-to-wheel joints. High loads may be applied at assembly to pre-stretch the tie-bolt to accommodate for the potential thermal expansion differences of the components.

SUMMARY

The present disclosure may comprise one or more of the following features and combinations thereof.

According to the present disclosure, a gas turbine engine may comprise a rotor and a tie bolt. The rotor may include a plurality of bladed wheels configured to rotate about an axis and interact with gases located radially outward of the rotor. The tie bolt may extend axially through the rotor along the axis and applies an axial compressive force to the plurality of bladed wheels to maintain axial connection between the plurality of bladed wheels. The tie bolt may include a cylindrical segment and a spring segment coupled with the cylindrical segment. The spring segment may have a varying outer diameter to form a bellows feature. The cylindrical segment may have a first stiffness and the spring segment may have a second stiffness that is less than the first stiffness. This may allow the tie bolt to expand and contract with the rotor due to thermal growth caused during use of the gas turbine engine assembly while maintaining the axial compressive force applied to the plurality of bladed wheels above a predetermined value.

In some embodiments, the spring segment may be fastened with the cylindrical segment for rotation therewith. In other embodiment, the spring segment may be threaded to the cylindrical segment for rotation therewith. In further embodiments, the spring segment may be integrally formed with the cylindrical segment. In an additional embodiment, the spring segment may be brazed or welded to the cylindrical segment for rotation therewith.

In further embodiments, the cylindrical segment may be made of first materials. The spring segment may be made of second materials different from the first materials.

In some embodiments, the plurality of bladed wheels includes compressor wheels. In another embodiment, the plurality of bladed wheels further includes turbine wheels.

In other embodiments, the cylindrical segment may include a first portion having a constant outer diameter and a second portion having a constant outer diameter. The spring segment may be located between and coupled to the first portion and the second portion of the cylindrical segment. In further embodiments, the varying outer diameter of the spring segment may have a maximum diameter and at least one of the plurality of bladed wheels has an inner diameter that is greater than the maximum diameter.

According to another aspect of the present disclosure, a gas turbine engine includes a rotor and a tie bolt. The rotor may include a plurality of wheels configured to rotate about an axis. The tie bolt may extend axially through the rotor along the axis and apply an axial compressive force to the plurality of wheels. The tie bolt may include a first segment having a first stiffness and a second segment formed to define a bellows feature and having a second stiffness that is less than the first stiffness.

In some embodiments, the first segment may be coupled with the second segment. The second segment may have a varying outer diameter to form the bellows feature. In a further embodiment, the first segment may include a first portion having a first outer diameter and a second portion having a second outer diameter. The second segment may be located between and coupled to the first portion and the second portion of the first segment. The second segment may have a third outer diameter greater than the first and second outer diameters.

In other embodiments, the second segment may have a maximum diameter. At least one of the plurality of wheels may have an innermost diameter. The innermost diameter of the plurality of wheels may be greater than the maximum diameter of the second segment.

In another embodiment, the plurality of wheels may include an impeller. In a further embodiment, the plurality of wheels includes bladed turbine wheels. In other embodiments, the first segment and the second segment of the tie bolt may be separate components that are coupled together for common rotation about the axis.

According to an aspect of the present disclosure, a method includes a number of steps. The method may include arranging a plurality of bladed wheels around a tie bolt that extends along an axis, the tie bolt including a first segment having a first stiffness and a second segment formed to define a bellows feature and having a second stiffness that is less than the first stiffness, and compressing axially the plurality of bladed wheels with the tie bolt to cause the second segment to deform elastically.

In some embodiments, the method may include coupling the first segment with the second segment for rotation therewith about the axis. In a further embodiment, the plurality of bladed wheels may include a first bladed wheel having a first innermost diameter and a second bladed wheel having a second innermost diameter, the bellows feature having a maximum outer diameter, and the maximum outer diameter is less than the first innermost diameter and greater than the second innermost diameter.

These and other features of the present disclosure will become more apparent from the following description of the illustrative embodiments.

DETAILED DESCRIPTION OF THE DRAWINGS

Figure 1:
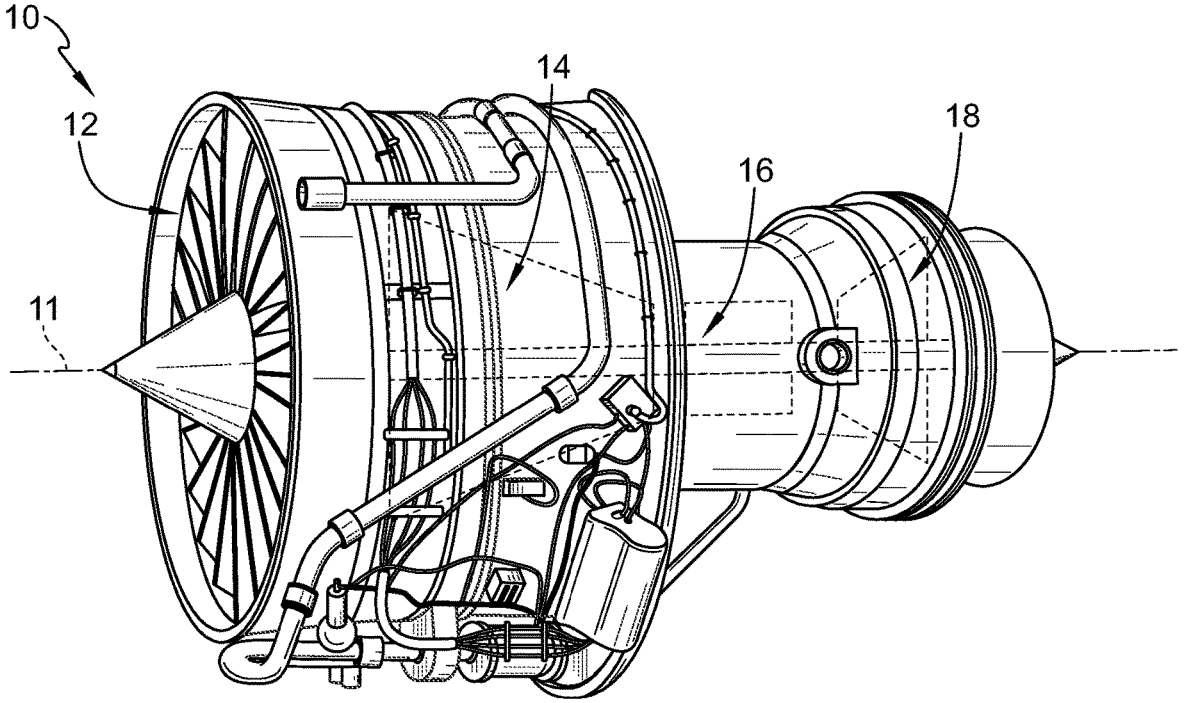
FIG. 1 is a perspective view of a gas turbine engine that includes a fan, a compressor, a combustor, and a turbine, the gas turbine engine including a tie bolt assembly for coupling rotating wheels of the compressor and/or turbine.

For the purposes of promoting an understanding of the principles of the disclosure, reference will now be made to a number of illustrative embodiments illustrated in the drawings and specific language will be used to describe the same.

An illustrative aerospace gas turbine engine 10 includes a fan 12, a compressor 14, a combustor 16, and a turbine 18 as shown in FIG. 1. The compressor 14 includes a rotor 20 and a tie bolt 22. The rotor 20 includes a plurality of bladed wheels 26 that are assembled in series axially and driven by the turbine 18 around a central axis 11 of the gas turbine engine 10. The tie bolt 22 is located radially inward of the rotor 20 and extends along a central axis 11 and axially clamps the plurality of bladed wheels 26 together.

Figure 2:
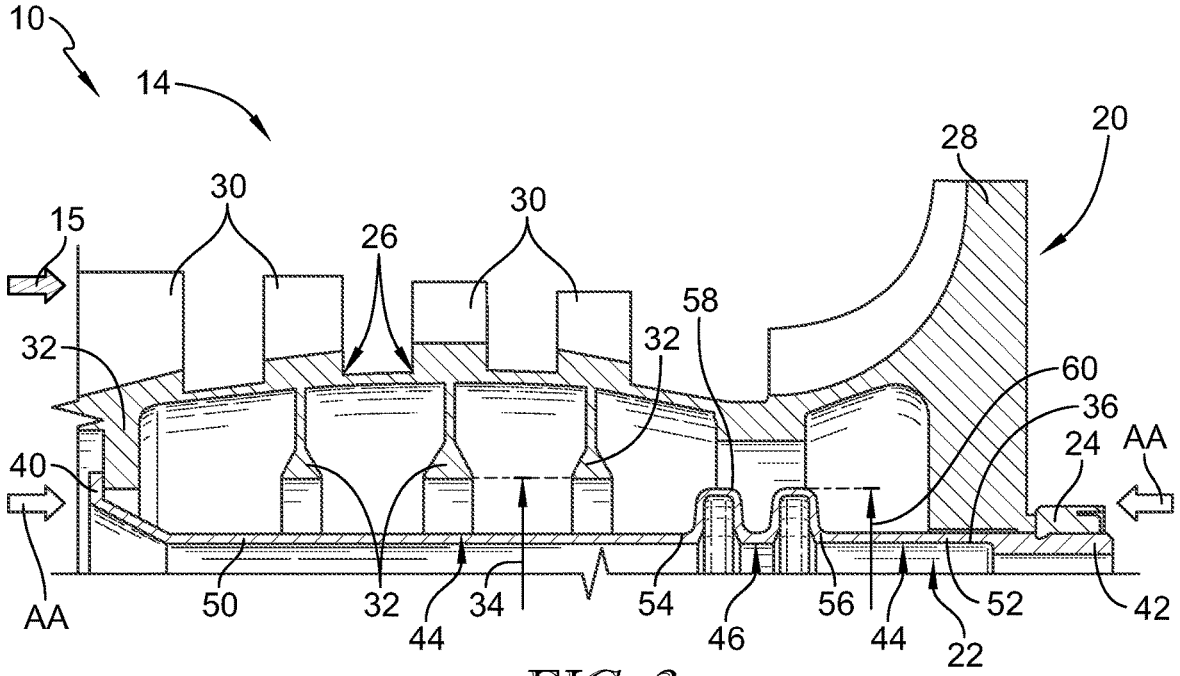
FIG. 2 is a cross-sectional view of a portion of the compressor included in the gas turbine engine of FIG. 1 showing the compressor includes a tie bolt and a plurality of bladed wheels, the tie bolt extends through the plurality of bladed wheels to clamp them together, and the tie bolt includes a spring segment that allows for the tie bolt to expand and contract with the plurality of bladed wheels due to thermal growth.

The tie bolt 22 includes a cylindrical segment 44 and a spring segment 46 as shown in FIG. 2. The spring segment 46 gives the tie bolt 22 additional flexibility in the axial direction to ease the process of assembling the compressor 14 in the cold-build state while maintaining a compressive force AA on the plurality of bladed wheels 26 through the engine cycle. During the engine cycle of the gas turbine engine 10, the plurality of bladed wheels 26 and the tie bolt 22 thermally grow at different rates. At some points in the engine cycle the plurality of bladed wheels 26 may cool down faster than the tie bolt 22, and the axial length of the plurality of bladed wheels 26 becomes shorter than the axial length of the tie bolt 22 compared to the cold-build assembly state of the two components.

In order to maintain the compressive force AA on the plurality of bladed wheels 26 above a predetermined value throughout the engine cycle, the tie bolt 22 is stretched during cold-build assembly to accommodate for the relative thermal growths and the differences in axial lengths during engine running. The compressive force AA may vary during operation of the gas turbine engine 10. For example, the compressive force AA may be greatest at cold build and during start up and then reduce in magnitude during flight and operation of the gas turbine engine. The tie bolt 22 is configured so that the compressive force AA is maintained at or above the predetermined threshold that keeps the plurality of bladed wheels 26 in a desired compressive state.

A conventional tie bolt does not include a spring section and may use large loads to create the pre-stretch in assembly because of the high stiffness of a conventional cylindrical tie bolt. The spring segment 46 of the present application gives the tie bolt 22 additional axial flexibility to aid assembly, but also allows for the compressive force AA to be applied to the plurality of bladed wheels 26 at all engine cycle points so that the compressive force AA is maintained above the predetermined value even with differing thermal growth of the components. The spring segment 46 may further allow for smaller axially loads to be used on the tie bolt 22 at assembly which may eliminate the use of specialized tools and/or moving the assembly around a shop floor to multiple stations.

The fan 12 is driven by the turbine 18 and provides thrust for propelling an air vehicle. The compressor 14 compresses and delivers air to the combustor 16. The combustor 16 mixes fuel with the compressed air received from the compressor 14 and ignites the fuel. The hot, high-pressure products of the combustion reaction in the combustor 16 are directed into the turbine 18 to cause the turbine 18 to rotate about a central axis 11 and drive the compressor 14 and the fan 12. In some embodiments, the fan 12 may be replaced with a propeller, drive shaft, or other suitable configuration.

The compressor 14 includes the rotor 20, the tie bolt 22, and a ring nut 24 as shown in in FIG. 2. The tie bolt 22 is located radially inward of the rotor 20 and extends axially along the central axis 11. The tie bolt 22 is assembled from a front end of the rotor 20 and extends axially aft through the rotor 20 and past an aft end of the rotor 20. The ring nut 24 is assembled radially outward of the tie bolt 22 to an aft threaded portion 42 of the tie bolt 22. The ring nut 24 has a threaded inner diameter that couples with to a threaded outer diameter of the aft threaded portion 42 of the tie bolt 22. The ring nut 24 has an outer diameter larger than an inner diameter of the aft end of the rotor 20 so that it engages the aft end of the rotor 20 when the ring nut 24 is tightened in the forward direction.

During assembly, the tie bolt 22 is stretched in the axial direction relative to the rotor 20 so that the tie bolt 22 can maintain a compressive force on the rotor 20 through the engine cycle. Once a predetermined value of stretch of the tie bolt 22 has been achieved, the ring nut 24 is tightened against the aft end of the rotor 20 to cause the tie bolt 22 and the ring nut 24 to cooperate and apply the compressive force AA to the rotor 20.

The rotor 20 includes a plurality of bladed wheels 26 that are assembled in series axially along the central axis 11 as shown in FIG. 2. In illustrative embodiment, the plurality of bladed wheels 26 includes an impeller 28 at the aft end of the rotor 20, axially aft of the other of the plurality of bladed wheels 26. The rotor 20 rotates around the central axis 11 and is driven by the turbine 18. The plurality of bladed wheels 26 includes multiple stages, each stage including a plurality of airfoils 30 and a plurality of wheels 32 that couple with the plurality of airfoils 30. In some embodiments, the rotor 20 may include a single stage or multiple stages of bladed disk assemblies. In another embodiment, the rotor 20 may include blisks. In a further embodiment, the rotor 20 may include combinations of bladed disk assemblies, blisks, and impellers.

Each stage of the plurality of bladed wheels 26 are coupled together to transmit torque from the turbine 18 to each of the plurality of bladed wheels 26. The plurality of airfoils 30 extend into the gas path 15 of the compressor 14 and compress the air in the gas path 15. The plurality of wheels 32 extend radially inward from the plurality of airfoils 30 and have an inner bore diameter 34. The impeller 28 extends radially inward and has an impeller bore diameter 36. The impeller bore diameter 36 is radially inward of the inner bore diameter 34 of the plurality of bladed wheels 26. The plurality of bladed wheels 26 may be connected together to transfer torque through the rotor 20 via splines, fasteners, or other suitable alternatives. The tie bolt 22 transmits little to no torque during operation of the gas turbine engine 10. The tie bolt 22 is configured to apply the compressive load AA to maintain engagement of the plurality of bladed wheels 26.

Figure 3:
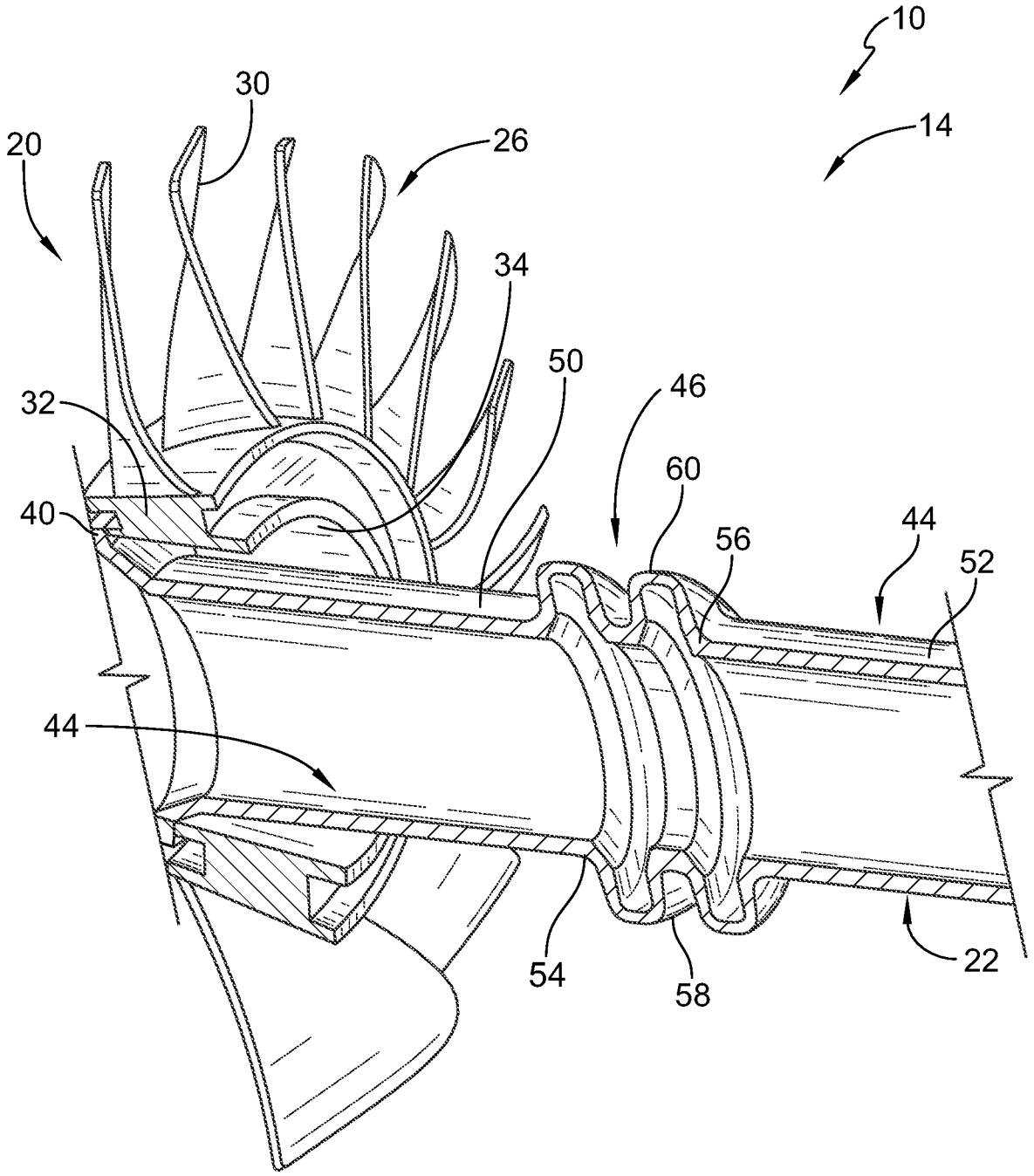
FIG. 3 is a cutaway perspective view of the compressor of FIG. 2 showing with many of the bladed wheels omitted to reveal the tie bolt is located radially inward of the plurality of bladed wheels, the tie bolt includes a cylindrical segment extending forward and aft of the spring segment, and the spring segment includes a bellows feature that extends radially outward and circumferentially around the central axis.

The tie bolt 22 extends circumferentially around the central axis 11 and includes a forward flange 40, an aft threaded portion 42, a cylindrical segment 44, and a spring segment 46 as shown in FIGS. 2 and 3. The tie bolt 22 provides a compressive force to the rotor 20 throughout the engine cycle. The forward flange 40 extends axially forward and radially outward from the cylindrical segment 44. The forward flange 40 has a radial dimension larger than the inner bore diameter 34 of the forward most plurality of wheels 32. The forward flange 40 engages with the forward end of the rotor 20 to transmit the axial compressive force AA rearward on to the rotor 20. The forward flange 40 may couple to forward end of the rotor 20 with a bolted joint, a curvic joint, a frictional surface joint, or a bonded joint. The aft threaded portion 42 is located at an aft terminal end of the tie bolt 22 and includes a threaded outer diameter that provides coupling means with the ring nut 24. The aft threaded portion 42 extends axially aft of the impeller 28 and has an outer diameter less than the impeller bore diameter 36.

In some embodiments, the compressor 14 may include a forward ring nut that couples with a forward threaded portion of the tie bolt 22. The forward ring may have a larger outer diameter than the inner bore diameter 34 of the forward most plurality of wheels 32 so that it engages the forward end of the rotor 20 to transmit the compressive force AA rearward on the rotor 20. In another embodiment, the tie bolt 22 may include a forward threaded portion that couples with a threaded inner diameter at a forward end of the rotor 20 and transmits the compressive force AA rearward on the rotor 20.

The cylindrical segment 44 includes a first portion 50 and a second portion 52 in the illustrative embodiment as shown in FIGS. 2 and 3. The first portion 50 has a constant outer diameter less than the inner bore diameter 34, and extends axially aft from the forward flange 40. The first portion 50 couples to the spring segment 46 at an aft terminal end of the first portion 50. The second portion 52 has a constant outer diameter less than the inner bore diameter 34 and the impeller bore diameter 36. The second portion 52 extends axially aft of the spring segment 46 and couples with the aft threaded portion 42.

In some embodiments, the first portion 50 and the second portion 52 have the same outer diameter. In another embodiment, the first portion 50 may have a larger diameter than the second portion 52. In a further embodiment, the first portion 50 may have a smaller outer diameter than the second portion 52. In other embodiments, the cylindrical segment 44 extends only forward or aft of the spring segment 46. In further embodiments, the first portion 50 and the second portion 52 may have varying diameters along the length of the first and second portions 50, 52. The first and second portions 50, 52 may include step changes in the diameters along the lengths of the first and second portions 50, 52 to accommodate engine geometry. The first and second portions 50, 52 may also include changes in thickness along the lengths of the first and second portions 50, 52.

The spring segment 46 is located axially aft of the first portion 50 of the cylindrical segment 44 and axially forward of the second portion 52 of the cylindrical segment 44 as shown in FIG. 2. The spring segment 46 includes a forward spring end 54, and aft spring end 56, and a bellows feature 58. The forward spring end 54 is coupled to the aft end of the first portion 50 of the cylindrical segment 44. The aft spring end 56 is coupled to the forward end of the second portion 52 of the cylindrical segment 44. The bellows feature 58 extends axially aft of the forward spring end 54 and includes multiple diaphragms in series along the axial length in the illustrative embodiment. In other embodiments, the bellows feature 58 includes a single diaphragm.

Each diaphragm extends radially outward to a bellows outer diameter 60, then axially aft a small length, and then radially inward. The bellows outer diameter 60 is less than the inner bore diameter 34 of the plurality of bladed wheels 26. This allows the spring segment 46 of the tie bolt 22 to pass axially aft through the plurality of bladed wheels 26 of the rotor 20 when the compressor is assembled.

The stiffness of the spring segment 46 can be tuned for a compressor assembly to give a desired minimum compressive force AA that is to be maintained during engine running. The axial stiffness of the spring segment 46 can be adjusted by varying the number of diaphragms in the bellows feature 58, the material of the bellows feature 58, and the geometry of each diaphragm. The stiffness of the bellows feature 58 is less than the stiffness of the first and second portions 50, 52 of the cylindrical segment 44. The material of the spring segment 46 may be the same as the material of the cylindrical segment 44. In other embodiments, the material of the spring segment 46 may be different from the material of the cylindrical segment 44.

The axial location of the spring segment 46 along the tie bolt 22 can be varied depending on the geometry of the rotor 20. In the illustrative embodiment shown in the FIG. 2, the spring segment 46 is located axially forward of the impeller 28 and axially aft of the plurality of bladed wheels 26. In some embodiments the spring segment can be located between individual wheels in the plurality of wheels 32. The inner diameters of the rotor 20 and the outer diameter of the diaphragms may be varied depending on design criteria. Some or all of the plurality of bladed wheels 26 may have different inner diameters.

The spring segment 46 is integrated with the cylindrical segment 44 so that the tie bolt 22 is formed as a single-piece component as shown in FIG. 2. In some embodiments, the spring segment 46 may be bonded to the cylindrical segment 44 by brazing, welding, or other suitable methods.

Figure 4:
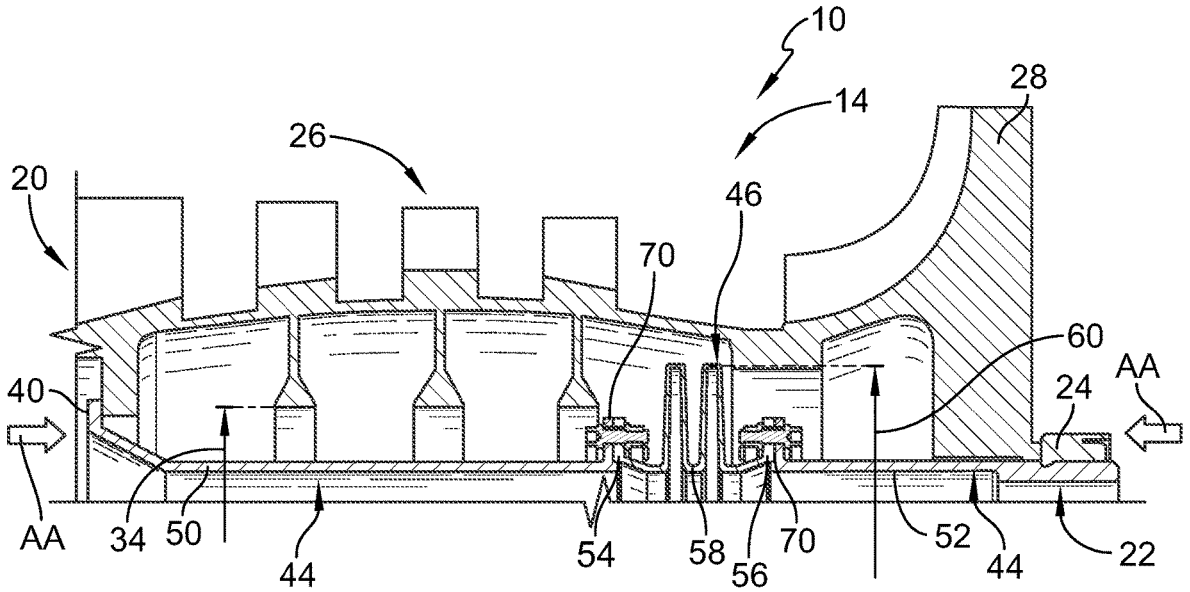
FIG. 4 is the cross-sectional view of a portion of another embodiment of the compressor of FIG. 1 showing the spring segment of the tie bolt is fastened by bolted joints to the cylindrical segments of the tie bolt.

In the illustrative embodiment of FIG. 4, the spring segment 46 is fastened to the cylindrical segment 44 using bolted flanges 70. The bolted flanges 70 have outer diameters less than the inner bore diameter 34 of the plurality of bladed wheels 26 to enable assembly. In the illustrative embodiment of FIG. 4, the bellows outer diameter 60 of the spring segment 46 may be larger than inner bore diameter 34 as the spring segment 46 may be assembled when the individual stages of the plurality of bladed wheels 26 are assembled together and does not need to axially pass through the rotor 20 for assembly.

Figure 5:
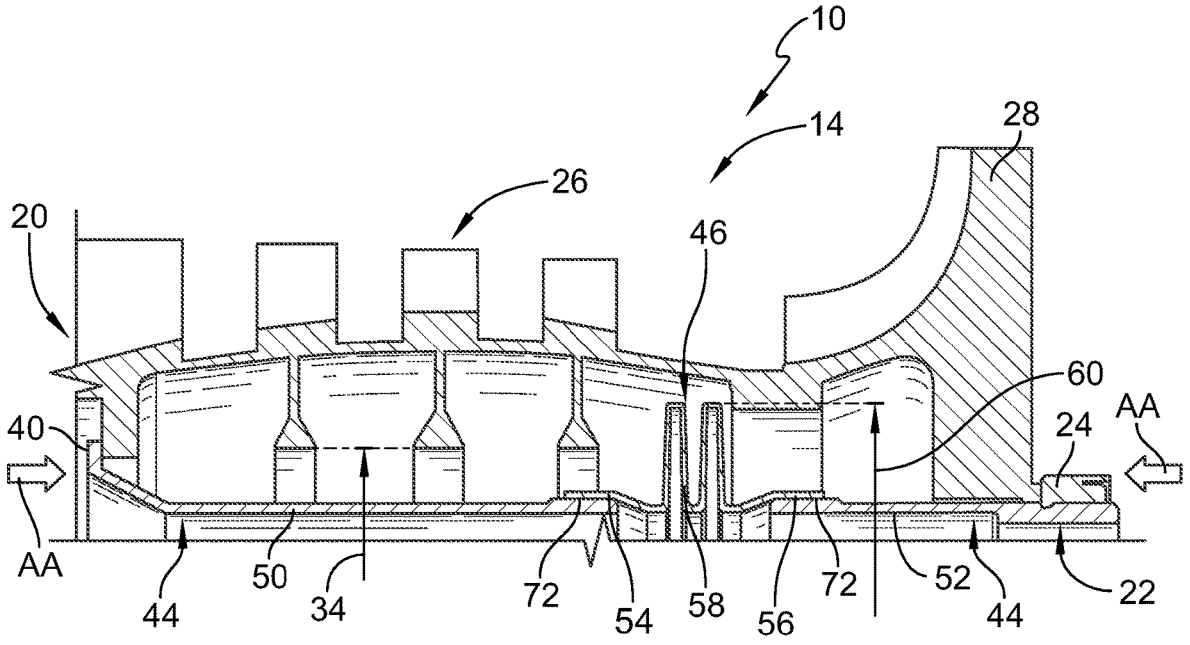
FIG. 5 is the cross-sectional view of a portion of another embodiment of the compressor of FIG. 1 showing the spring segment of the tie bolt is threaded to the cylindrical segments of the tie bolt.

In the illustrative embodiment of FIG. 5, the spring segment 46 may be fastened to the cylindrical segment 44 using threaded portions 72. In the illustrative embodiment of FIG. 5, the bellows outer diameter 60 of the spring segment 46 may be larger than inner bore diameter 34 as the spring segment 46 may be assembled when the individual stages of the plurality of bladed wheels are assembled together and does not need to axially pass through the rotor 20 for assembly.

Figure 6:
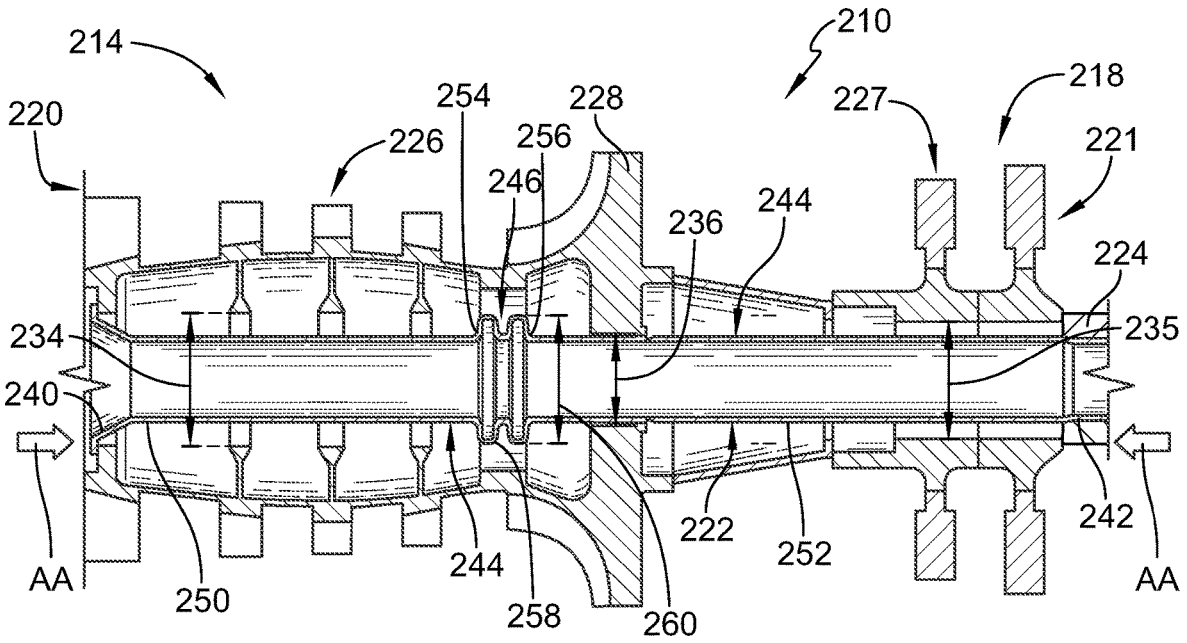
FIG. 6 is a cross-sectional view of a portion of another embodiment of the gas turbine engine of FIG. 1 showing the compressor includes a plurality of bladed wheels, the turbine includes a plurality of turbine wheel assemblies, and the tie bolt extends through the compressor and the turbine and includes a spring segment located forward of an impeller, the tie bolt applying an axial compressive force to clamp the plurality of bladed wheels and the plurality of turbine wheel assemblies together.
Figure 7:
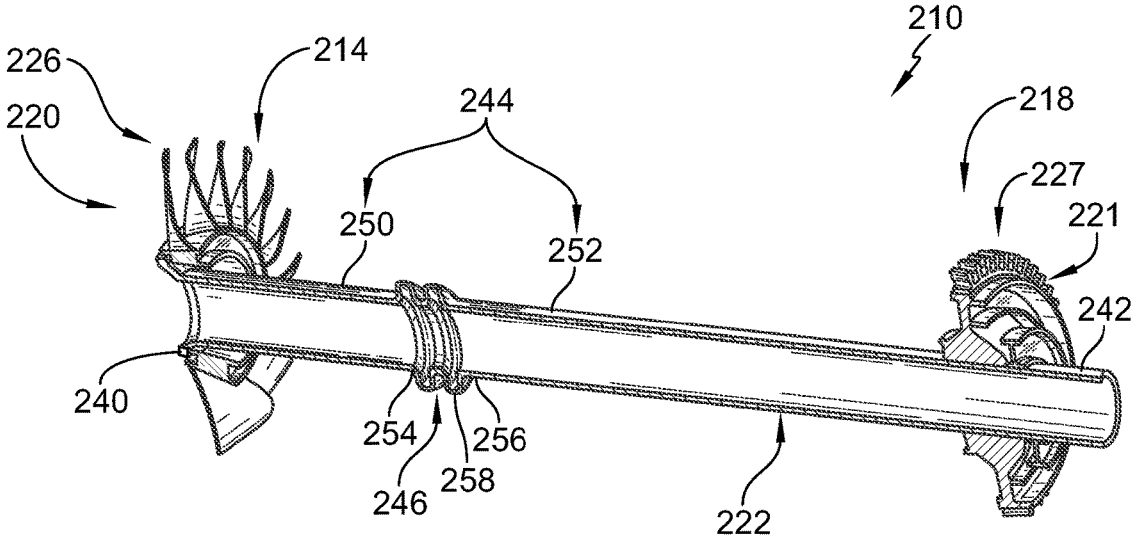
FIG. 7 is a cutaway perspective view of the assembly of FIG. 6 with some of the bladed wheels removed to show that the tie bolt includes a forward portion that locates radially inward of the compressor bladed wheels, an aft portion that locates radially inward of the turbine wheel assemblies, and a spring segment located between the forward portion and the aft portion of the tie bolt.
Figure 8:
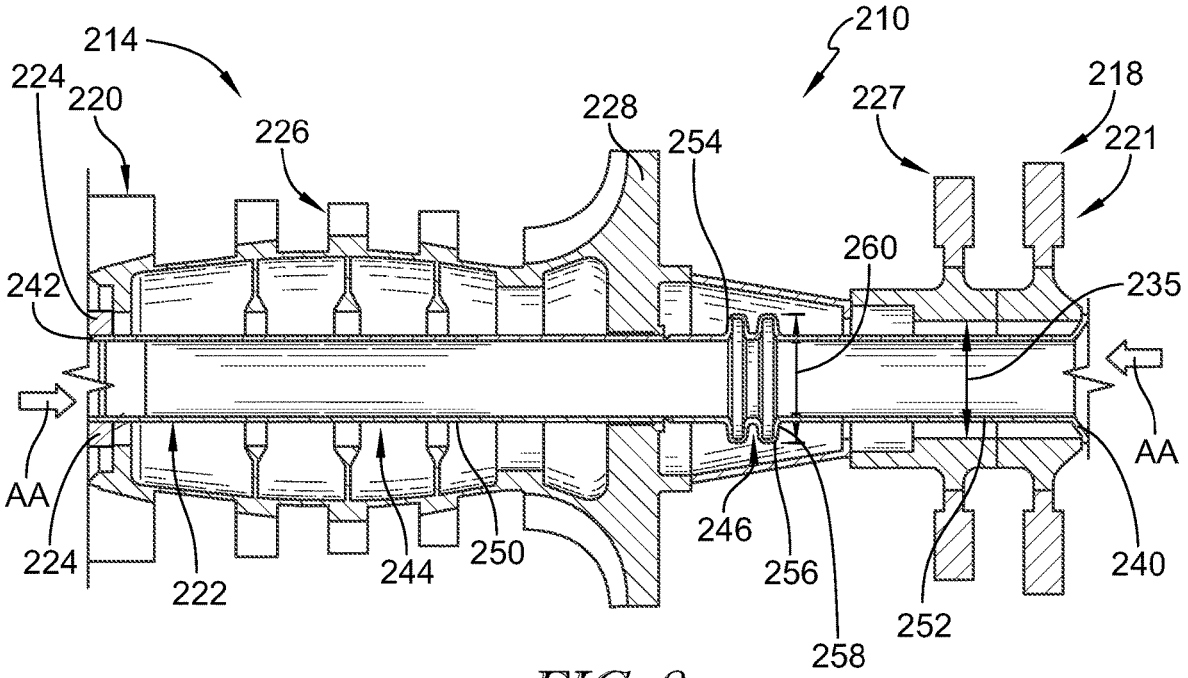
FIG. 8 is a cross-sectional view similar to FIG. 6 showing an embodiment in which the tie bolt includes a spring segment located aft of an impeller, the tie bolt applying an axial compressive force to clamp the plurality of bladed wheels of the compressor and the plurality of turbine wheel assemblies together.

Another embodiment of a gas turbine engine 210 in accordance with the present disclosure is shown in FIGS. 6-8. The gas turbine engine 210 is substantially similar to the gas turbine engine 10 shown in FIGS. 1-5 and described herein. Accordingly, similar reference numbers in the 200 series indicate features that are common between the gas turbine engine 210 and the gas turbine engine 10. The description of the gas turbine engine 10 is incorporated by reference to apply to the gas turbine engine 210, except in instances when it conflicts with the specific description and the drawings of the gas turbine engine 210.

The gas turbine engine 210 includes a compressor rotor 220, a turbine rotor 221, a tie bolt 222, and a ring nut 224 as shown in in FIGS. 6-8. The tie bolt 222 is located radially inward of the compressor rotor 220 and the turbine rotor 221. The tie bolt 222 extends axially through the compressor rotor 220, the turbine rotor 221, and past an aft end of the turbine rotor 221. The ring nut 224 is assembled radially outward of the tie bolt 222 to an aft threaded portion 242 of the tie bolt 222. The ring nut 224 has a threaded inner diameter that couples with to a threaded outer diameter of the aft threaded portion 242 of the tie bolt 222. The ring nut 224 has an outer diameter larger than an inner diameter of the aft end of the turbine rotor 221 so that it engages the aft end of the turbine rotor 221 when the ring nut 224 is tightened in the forward direction.

The tie bolt 222 is stretched in the axial direction so that the tie bolt 222 maintains a compressive force in the assembly above the predetermined threshold throughout the engine cycle. Once a predetermined value of stretch of the tie bolt 222 has been achieved, the ring nut 224 is tightened against the aft end of the turbine rotor 221. In some embodiments, the tie bolt 222 may be assembled axially forward through the rotors 220, 221, and the ring nut 224 may be located on a forward end of the tie bolt 222 and engage a forward end of the compressor rotor 220.

The compressor rotor 220 includes a plurality of bladed wheels 226 that are assembled in series axially along the central axis 11 as shown in FIGS. 6 and 8. In illustrative embodiment, the plurality of bladed wheels 226 includes an impeller 228 at the aft end of the compressor rotor 220. The turbine rotor 221 includes a plurality of turbine wheel assemblies 227 that are assembled in series axially along the central axis 11. The compressor rotor 220 rotates around the central axis 11 and is coupled to and driven by the turbine rotor 221. In some embodiments, the compressor rotor 220 and the turbine rotor 221 may comprise a combination of bladed disk assemblies, impellers, and blisks.

The tie bolt 222 extends circumferentially around the central axis 11 and includes a forward flange 240, an aft threaded portion 242, a cylindrical segment 244, and a spring segment 246 as shown in FIGS. 6-8. The tie bolt 222 provides a compressive force to the compressor rotor 220 and the turbine rotor 221 throughout the engine cycle. This allows for the compressor rotor 220 to maintain connection with the turbine rotor 221 throughout the engine cycle. Torque is transmitted through the turbine rotor 221 and the compressor rotor 220. The tie bolt 222 transmits little or no torque.

The forward flange 240 extends axially forward and radially outward from the cylindrical segment 244. The forward flange 240 has a radial dimension larger than an inner bore diameter 234 of the forward most wheel in the compressor rotor 220. The aft threaded portion 242 is located at an aft terminal end of the tie bolt 222 and extends axially aft of the turbine rotor 221. The aft threaded portion 242 has an outer diameter less than a turbine inner bore diameter 235.

In some embodiments, the compressor 214 may include a forward ring nut that couples with a forward threaded portion of the tie bolt 222. The forward ring may have a larger outer diameter than the inner bore diameter 234 of the forward most plurality of bladed wheels 226 so that it engages the forward end of the compressor rotor 220 to transmit the compressive force AA rearward on the compressor rotor 220. In another embodiment, the tie bolt 222 may include a forward threaded portion that couples with a threaded inner diameter at a forward end of the compressor rotor 220 and transmits the compressive force AA rearward on the compressor rotor 220.

The cylindrical segment 244 includes a first portion 250 and a second portion 252 as shown in FIGS. 6-8. In the illustrative embodiment, the first portion 250 has a constant outer diameter less than the inner bore diameter 234, and extends axially aft from the forward flange 240. The first portion 250 couples to the spring segment 246 at an aft terminal end of the first portion 250. The second portion 252 has a constant outer diameter less than the inner bore diameter 234 and the turbine inner bore diameter 235. The second portion 252 extends axially aft of the spring segment 246 and couples with the aft threaded portion 242.

In some embodiments, the first portion 250 and the second portion 252 have the same outer diameter. In another embodiment, the first portion 250 may have a larger diameter than the second portion 252. In a further embodiment, the first portion 250 may have a smaller outer diameter than the second portion 252. In further embodiments, the first portion 250 and the second portion 252 may have varying diameters along the length of the first and second portions 250, 252. The first and second portions 250, 252 may include step changes in the diameters along the lengths of the first and second portions 250, 252 to accommodate engine geometry. The first and second portions 250, 252 may also include changes in thickness along the lengths of the first and second portions 250, 252.

The spring segment 246 is located axially aft of the first portion 250 of the cylindrical segment 244 and axially forward of the second portion 252 of the cylindrical segment 244 as shown in FIGS. 6-8. The spring segment 246 includes a forward spring end 254, and aft spring end 256, and a bellows feature 258. The forward spring end 254 is coupled to the aft end of the first portion 250 of the cylindrical segment 244. The aft spring end 256 is coupled to the forward end of the second portion 252 of the cylindrical segment 244. The bellows feature 258 extends axially aft of the forward spring end 254 and includes multiple diaphragms in series along the axial length. Each diaphragm extends radially outward to a bellows outer diameter 260, then axially aft a small length, and then radially inward.

The spring segment 246 is integrated with the first and second portions 250, 252 of the cylindrical segment 244 as shown in FIGS. 6-8. The spring segment 246 may be formed with the cylindrical segment 244 for form a single-piece tie bolt 222. In some embodiments, the spring segment 246 may be fastened with the cylindrical segment 244 using bolted flanges. In another embodiment, the spring segment 246 may be coupled with the cylindrical segment 244 using threaded coupling means. In a further embodiment, the spring segment 246 may be bonded with the cylindrical segment 244 by brazing, welding, or other suitable methods.

In the illustrative embodiment of FIG. 6, the bellows outer diameter 260 is less than the inner bore diameter 234 of the compressor rotor 220. This allows the spring segment 246 of the tie bolt 222 to pass axially aft through the plurality of bladed wheels 226 of the compressor rotor 220 during assembly. The spring segment 246 is located axially forward of the impeller 228. The bellows outer diameter 260 is greater than an inner impeller diameter 236 so the spring segment 246 is limited to being forward of the impeller 228 in this embodiment. The second portion 252 of the tie bolt 222 extends axially aft through the bore of the impeller 228 and the turbine inner bore diameter 235.

In the illustrative embodiment of FIG. 8, the spring segment 246 is located axially aft of the impeller 228, and the tie bolt 222 is assembled from the aft end of the turbine rotor 221 axially forward through the assembly. The forward flange 240 is reversed in this configuration and engages the aft most turbine wheel assembly 227 of the turbine rotor 221. The ring nut 224 assembles to a forward threaded portion of the tie bolt 222 and engages the forward most bladed wheel of the compressor rotor 220. The bellows outer diameter 260 is less than the turbine inner bore diameter 235 of the turbine rotor 221. This allows the spring segment 246 of the tie bolt 222 to pass axially forward through the plurality of turbine wheel assemblies 227 of the turbine rotor 221 during assembly. The bellows outer diameter 260 is greater than the inner impeller diameter 236 so the spring segment 246 is limited to being located aft of the impeller 228 in this embodiment. The first portion 250 of the tie bolt 222 extends axially forward through the bore of the impeller 228 and the compressor rotor 220.

Figure 9:
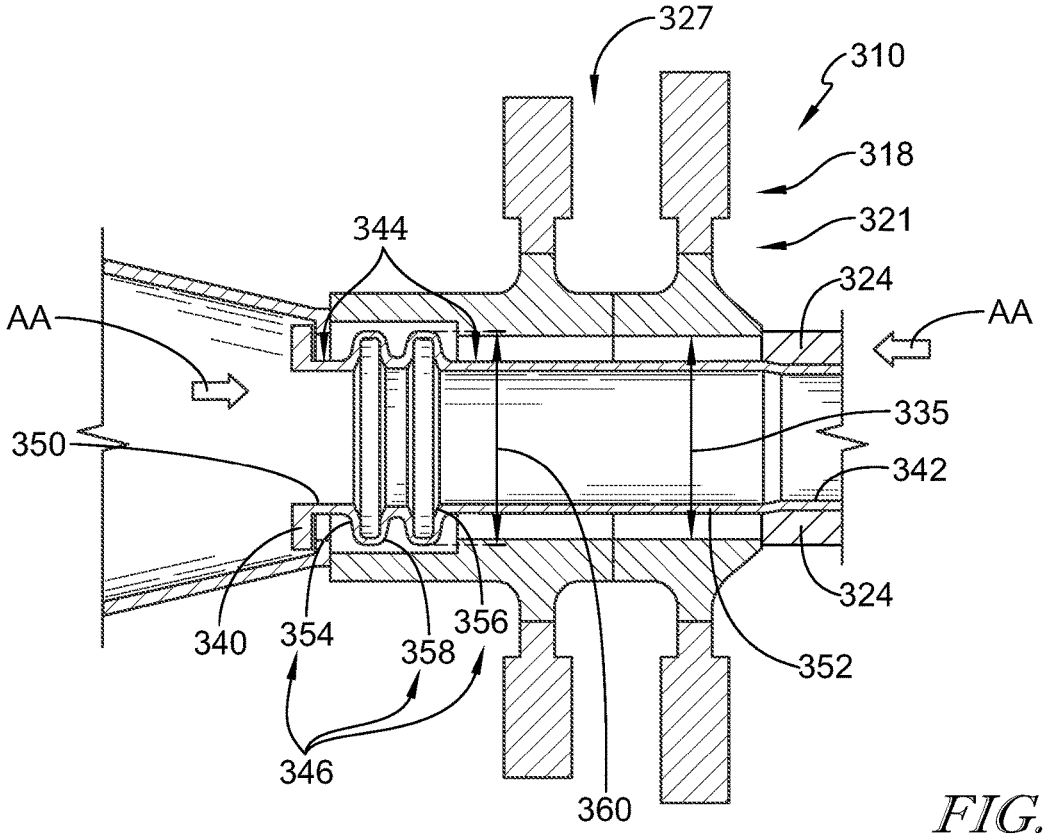
FIG. 9 is a cross-sectional view of a portion of an embodiment of the turbine included in the gas turbine engine of FIG. 1 showing the turbine includes a tie bolt and a plurality of turbine wheel assemblies, the tie bolt includes a spring segment and extends radially inward and axially through the plurality of turbine wheel assemblies, and the plurality of turbine wheel assemblies are axially clamped together by a compressive force applied by the tie bolt.

Another embodiment of a gas turbine engine 310 in accordance with the present disclosure is shown in FIG. 9. The gas turbine engine 310 is substantially similar to the gas turbine engine 10 shown in FIGS. 1-5 and described herein. Accordingly, similar reference numbers in the 300 series indicate features that are common between the gas turbine engine 310 and the gas turbine engine 10. The description of the gas turbine engine 10 is incorporated by reference to apply to the gas turbine engine 310, except in instances when it conflicts with the specific description and the drawings of the gas turbine engine 310.

The gas turbine engine 310 includes a turbine rotor 321, a tie bolt 322, and a ring nut 324 as shown in in FIG. 9. The tie bolt 322 is located radially inward of the turbine rotor 321. The tie bolt 322 extends axially through the turbine rotor 321 and past an aft end of the turbine rotor 321. The ring nut 324 is assembled radially outward of the tie bolt 322 to an aft threaded portion 342 of the tie bolt 322. The ring nut 324 has a threaded inner diameter that couples with to a threaded outer diameter of the aft threaded portion 342 of the tie bolt 322. The ring nut 324 has an outer diameter larger than an inner diameter of the aft end of the turbine rotor 321 so that it engages the aft end of the turbine rotor 321 when the ring nut 324 is tightened in the forward direction.

The turbine rotor 321 includes a plurality of turbine wheel assemblies 327 that are assembled in series axially along the central axis 11 as shown in FIG. 9. The turbine rotor 321 rotates around the central axis 11 and drives the compressor 314 and fan 312. The tie bolt 322 is stretched in the axial direction so that the tie bolt 322 can maintain a compressive force on a plurality of turbine wheel assemblies 327 above a predetermined threshold throughout the engine cycle. Once a predetermined value of stretch of the tie bolt 322 has been achieved, the ring nut 324 is tightened against the aft end of the turbine rotor 321.

The tie bolt 322 extends circumferentially around the central axis 11 and includes a forward flange 340, an aft threaded portion 342, a cylindrical segment 344, and a spring segment 346 as shown in FIG. 9. The tie bolt 322 provides the compressive force to the turbine rotor 321 above the predetermined threshold throughout the engine cycle. This allows for the plurality of turbine wheel assemblies 327 to maintain connection with one another throughout the engine cycle. The forward flange 340 extends axially forward and radially outward from the cylindrical segment 344. The forward flange 340 has a radial dimension larger than a turbine inner bore diameter 335 of the forward most wheel in the plurality of turbine wheel assemblies 327. The aft threaded portion 342 is located at an aft terminal end of the tie bolt 322 and extends axially aft of the turbine rotor 321. The aft threaded portion 342 has an outer diameter less than a turbine inner bore diameter 335.

In some embodiments, the turbine 318 may include a forward ring nut that couples with a forward threaded portion of the tie bolt 322. The forward ring may have a larger outer diameter than the turbine inner bore diameter 335 of the forward wheel in the plurality of turbine wheel assemblies 327 so that it engages the forward end of the turbine rotor 321 to transmit the compressive force AA rearward on the turbine rotor 321. In another embodiment, the tie bolt 322 may include a forward threaded portion that couples with a threaded inner diameter at a forward end of the turbine rotor 321 and transmits the compressive force AA rearward on the rotor 321.

The cylindrical segment 344 includes a first portion 350 and a second portion 352 as shown in FIG. 9. In the illustrative embodiment, the first portion 350 has a constant outer diameter and extends axially aft from the forward flange 340. The first portion 350 couples to the spring segment 346 at an aft terminal end of the first portion 350. The second portion 352 has a constant outer diameter less than the turbine inner bore diameter 235. The second portion 352 extends axially aft of the spring segment 346 and couples with the aft threaded portion 342.

In some embodiments, the first portion 350 and the second portion 352 have the same outer diameter. In another embodiment, the first portion 350 may have a larger diameter than the second portion 352. In a further embodiment, the first portion 350 may have a smaller outer diameter than the second portion 352. In further embodiments, the first portion 350 and the second portion 352 may have varying diameters along the length of the first and second portions 350, 352. The first and second portions 350, 352 may include step changes in the diameters along the lengths of the first and second portions 350, 352 to accommodate engine geometry. The first and second portions 350, 352 may also include changes in thickness along the lengths of the first and second portions 350, 352.

The spring segment 346 is located axially aft of the first portion 350 of the cylindrical segment 344 and axially forward of the second portion 352 of the cylindrical segment 344 as shown in FIG. 9. The spring segment 346 includes a forward spring end 354, and aft spring end 356, and a bellows feature 358. The forward spring end 354 is coupled to the aft end of the first portion 350 of the cylindrical segment 344. The aft spring end 356 is coupled to the forward end of the second portion 352 of the cylindrical segment 344. The bellows feature 358 extends axially aft of the forward spring end 354 and includes multiple diaphragms in series along the axial length. Each diaphragm extends radially outward to a bellows outer diameter 360, then axially aft a small length, and then radially inward.

The spring segment 346 is integrated with the first and second portions 350, 352 of the cylindrical segment 344 as shown in FIG. 9. The spring segment 346 may be formed with the cylindrical segment 344 for form a single-piece tie bolt 322. In some embodiments, the spring segment 346 may be fastened with the cylindrical segment 344 using bolted flanges. In another embodiment, the spring segment 346 may be coupled with the cylindrical segment 344 using threaded coupling means. In a further embodiment, the spring segment 346 may be bonded with the cylindrical segment 344 by brazing, welding, or other suitable methods.

In a gas turbine engine 10, a plurality of bladed wheels 26 may be clamped together in some fashion in order to transfer torque developed from the flow path 15. During assembly of a tie-bolt 22 as shown in FIG. 2, the rotor 20 may be stacked on the tie bolt 22. Tooling may be used to stretch the tie bolt 22 and a spanner nut 24 may be subsequently torqued down to react the load imparted from the stretch through the rotor 20.

Since a conventional tie-bolt is typically cylindrical, it is relatively stiff and generates large loads over a small stretch range. Due to differences in materials and masses in a tie-bolted rotor configuration, thermal growth of the conventional tie bolt is often very different from the rest of the rotor components which results in large reductions in clamp load during mission transients. Under some conditions, the rotor may shrink faster than the tie bolt, effectively reducing the stretch used to generate the clamp force holding the rotor together. To ensure the rotor maintains positive clamp throughout its duty cycle, large pre-loads, by stretching the tie bolt, are used with conventional tie bolts at assembly which can be difficult to execute efficiently in a shop environment. When a tie bolt is used to clamp both a compressor and turbine rotor, the thermal mismatch between the tie bolt may be further exacerbated by the relatively cool compressor and relatively hot turbine.

The presented disclosure provides solutions to the above mentioned challenges. The present disclosure provides for a spring segment 46 in the tie bolt 22 to allow larger assembly stretch while keeping assembly loads manageable. The spring segment 46 may reduce the stiffness of the tie-bolt 22, allowing more assembly pre-stretch to be obtained at a given assembly load. Thus, a larger operational deflection range can be accommodated for a given assembly stretch. This is accomplished either through a feature integral to the tie-bolt as shown in FIGS. 2 and 3, a separate component bolted into the tie-bolt as shown in FIG. 4, or a separate component threaded onto the shaft in a turnbuckle-style configuration as shown in FIG. 5.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A gas turbine engine assembly comprising a rotor that includes a plurality of bladed wheels configured to rotate about an axis and interact with gases located radially outward of the rotor, a tie bolt that extends axially through the rotor along the axis and applies an axial compressive force to the plurality of bladed wheels to maintain axial connection between the plurality of bladed wheels, the tie bolt including a cylindrical segment and a spring segment coupled with the cylindrical segment and having a varying outer diameter to form a bellows feature, wherein the cylindrical segment has a first stiffness and the spring segment has a second stiffness that is less than the first stiffness to allow the tie bolt to expand and contract with the rotor due to thermal growth caused during use of the gas turbine engine assembly while maintaining the axial compressive force applied to the plurality of bladed wheels above a predetermined value, wherein the tie bolt includes a flange and a nut spaced apart axially from the flange, the flange and the nut are coupled with the cylindrical segment and cooperate to apply the axial compressive force to the plurality of bladed wheels, and the spring segment is located axially between the flange and the nut to accommodate for thermal growth of the tie bolt while maintaining the axial compressive force applied to the plurality of bladed wheels above the predetermined value during use of the gas turbine engine assembly.

2. The gas turbine engine assembly of claim 1, wherein the spring segment is fastened with the cylindrical segment for rotation therewith.

3. The gas turbine engine assembly of claim 1, wherein the spring segment is threaded to the cylindrical segment for rotation therewith.

4. The gas turbine engine assembly of claim 1, wherein the spring segment is integrally formed with the cylindrical segment.

5. The gas turbine engine assembly of claim 1, wherein the spring segment is one of brazed and welded to the cylindrical segment for rotation therewith.

6. The gas turbine engine assembly of claim 1, wherein the cylindrical segment is made of first materials and the spring segment is made of second materials different from the first materials.

7. The gas turbine engine assembly of claim 1, wherein the plurality of bladed wheels includes compressor wheels.

8. The gas turbine engine assembly of claim 7, wherein the plurality of bladed wheels further includes turbine wheels.

9. The gas turbine engine assembly of claim 1, wherein the cylindrical segment includes a first portion having a constant outer diameter and a second portion having a constant outer diameter and the spring segment is located between and coupled to the first portion and the second portion of the cylindrical segment.

10. The gas turbine engine assembly of claim 9, wherein the varying outer diameter of the spring segment has a maximum diameter and at least one of the plurality of bladed wheels has an inner diameter that is greater than the maximum diameter.

11. A gas turbine engine assembly comprising a rotor that includes a plurality of wheels configured to rotate about an axis, a tie bolt that extends axially through the rotor along the axis and applies an axial compressive force to the plurality of wheels, the tie bolt including a first segment having a first stiffness and a second segment formed to define a bellows feature and having a second stiffness that is less than the first stiffness, wherein the first segment includes a first portion having a first outer diameter and a second portion having a second outer diameter, and the second segment has a third outer diameter that is greater than the first outer diameter and the second outer diameter, wherein the tie bolt includes a first engagement feature coupled with the first portion of the first segment of the tie bolt and a second engagement feature spaced apart axially from the first engagement feature and coupled with the second portion of the first segment of the tie bolt, the first engagement feature and the second engagement feature cooperate to apply the axial compressive force to the plurality of wheels between the first engagement feature and the second engagement feature, and the second segment having the second stiffness is located axially between and coupled to the first portion and the second portion of the first segment.

12. The gas turbine engine assembly of claim 11, wherein the first segment is coupled with the second segment and the second segment has a varying outer diameter to form the bellows feature.

13. The gas turbine engine assembly of claim 11, wherein the second segment has a maximum diameter and at least one of the plurality of wheels has an innermost diameter that is greater than the maximum diameter.

14. The gas turbine engine assembly of claim 11, wherein the plurality of wheels includes an impeller.

15. The gas turbine engine assembly of claim 11, wherein the plurality of wheels includes bladed turbine wheels.

16. The gas turbine engine assembly of claim 11, wherein the first segment and the second segment of the tie bolt are separate components that are coupled together for common rotation about the axis.

17. A method comprising arranging a plurality of bladed wheels around a tie bolt that extends along an axis, the tie bolt including a cylindrical segment having a first stiffness and a spring segment formed to define a bellows feature and having a second stiffness that is less than the first stiffness, the tie bolt further including a flange and a nut spaced apart axially from the flange, the flange and the nut being coupled with the cylindrical segment, and the spring segment is located axially between the flange and the nut, wherein a gas turbine engine assembly comprises a rotor that includes the plurality of bladed wheels, the plurality of bladed wheels configured to rotate about the axis and interact with gases located radially outward of the rotor, and the spring segment is coupled with the cylindrical segment and having a varying outer diameter to form the bellows features, and compressing axially the plurality of bladed wheels with the flange and the nut of the tie bolt to cause the spring segment to deform elastically and accommodate for thermal growth of the tie bolt while maintaining an axial compressive force applied to the plurality of bladed wheels above a predetermined value during use of the gas turbine engine assembly, wherein the second stiffness allows the tie bolt to expand and contract with the rotor due to thermal growth caused during use of the gas turbine engine assembly while maintaining the axial compressive force applied to the plurality of bladed wheels above the predetermined value.

18. The method of claim 17, further comprising coupling the cylindrical segment with the spring segment for rotation therewith about the axis.

19. The method of claim 17, wherein the plurality of bladed wheels includes a first bladed wheel having a first innermost diameter and a second bladed wheel having a second innermost diameter, the bellows feature having a maximum outer diameter, and the maximum outer diameter is less than the first innermost diameter and greater than the second innermost diameter.

20. The gas turbine engine assembly of claim 11, wherein the first engagement feature is a flange coupled with the first portion of the first segment of the tie bolt and the second engagement feature is a nut coupled with the second portion of the first segment of the tie bolt.

* * * * *